United States Patent [19]

Pfeifer

[11] 4,261,814

[45] Apr. 14, 1981

[54] VACUUM PIPESTILL OPERATION

[75] Inventor: Klaus A. Pfeifer, Cologne, Fed. Rep. of Germany

[73] Assignee: Exxon Research and Engineering Co., Florham Park, N.J.

[21] Appl. No.: 963,022

[22] Filed: Nov. 22, 1978

[30] Foreign Application Priority Data

Nov. 30, 1977 [GB] United Kingdom ..... 49851/77

[51] Int. Cl.[3] ..... B01D 3/34

[52] U.S. Cl. ..... 208/356; 196/98; 196/134; 202/205; 203/92; 208/357

[58] Field of Search ..... 208/354, 356, 357; 196/98, 134; 202/205; 203/92

[56] References Cited

U.S. PATENT DOCUMENTS

| | | | |
|---|---|---|---|
| 1,472,116 | 10/1923 | Doherty | 208/356 |
| 2,009,079 | 7/1935 | Burkhard | 208/356 |
| 2,057,004 | 10/1936 | Burkhard | 208/356 |
| 3,110,663 | 11/1963 | Miller | 208/354 |

*Primary Examiner*—Herbert Levine

*Attorney, Agent, or Firm*—Reuben Miller

[57] ABSTRACT

The invention provides an improvement in the conventional operation of a vacuum pipestill, whereby when used with, for example, an atmospheric residuum either (a) conventional yields are obtainable with less stripping steam utilization, or (b) a deeper cut into the residuum is obtainable for conventional steam utilization. Some of the gaseous mixture normally withdrawn from the top of the vacuum pipestill for washing and removal is fed into compression and recycle means and recycled to the stripping zone of the pipestill to replace, or augment, the conventionally used stripping steam.

8 Claims, 2 Drawing Figures

VACUUM PIPESTILL OPERATION

Figure 1:
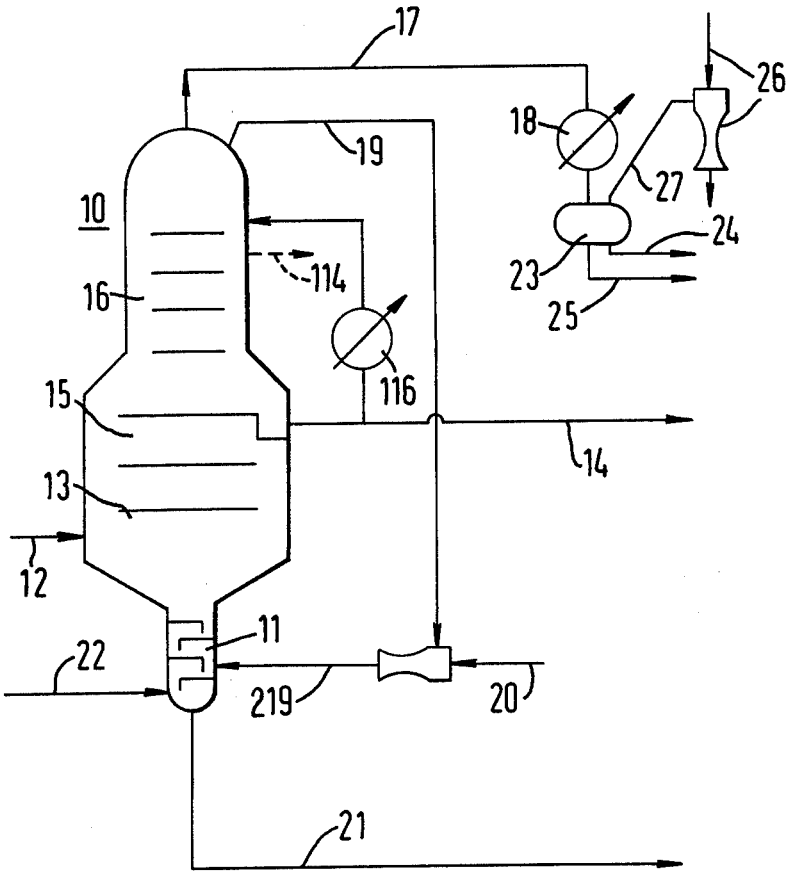

This invention relates to the operation of a vacuum pipestill such as is found in a petroleum refinery. Whilst the invention is applicable to the operation of a vacuum pipestill for producing a fuel fraction or a lube oil fraction, it is especially advantageous with a vacuum pipestill producing vacuum gas oil.

A fuels vacuum pipestill (hereafter abbreviated to VPS) operates to produce vacuum gas oil from the bottoms received from, for example, an atmospheric pipestill. The hot bottoms product from an atmospheric pipestill, that is to say an atmospheric residuum, is first heated in a pipestill furnace from an initial temperature of approximately 370° C. to an outlet temperature of approximately 430° C. The thus heated bottoms from the furnace then enter the VPS, which at the entry point is at, for example, 70 to 110 mm Hg absolute pressure. In the VPS light hydrocarbons flash off, as does also a heavier fraction, whilst the heaviest material drops out as bottoms. The said heavier fraction is a flash distillate fuel cut, generally called vacuum gas oil, useful in itself but particularly useful as the source of lighter hydrocarbons, and thus the vacuum gas oil is advantageously used as a feed to a thermal-cracking or a catalytic-cracking unit.

It is conventional to inject steam, pre-heated in the pipestill furnace, into the base portion of the VPS as a stripping agent for the bottoms product in the VPS, whereby light hydrocarbons and vacuum gas oil hydrocarbons are more effectively removed so that the flash point of the bottoms product is of a sufficiently high and consistent value to render it useful as, or after further treatment as, a petroleum asphalt.

It is often highly desirable to increase the amount of vacuum gas oil produced from a given atmospheric residuum feed to a VPS. This requires flashing off more of the said heavier, vacuum gas oil, fraction and results, of course, in addition to more vacuum gas oil, in a bottoms product of higher flash point. This procedure is called "cutting deeper" into the feed material. In practice, however, for a given conventional VPS, the ability to cut deeper is severely limited by one or more of the following factors: (a) limit to the temperature of the feed material from the pipestill furnace to the VPS, because to raise the temperature requires the use of excessive fuel and can result in cracking of the atmospheric residuum and coking of the pipestill furnace coils; (b) the degree of reduced pressure economically possible in the VPS; (c) the maximum capacity of the VPS overhead condensing and sour water treatment systems limits the amount of stripping steam which can be employed.

The easiest of the above factors to vary is the last. By installation of substantial additional condensing and water-treating systems more stripping steam could be employed.

However, this is a very costly remedy and, in practice, does not represent a realistic solution to the problem.

Indeed, the steam requirements even in a normal VPS operation represent a vary significant proportion of VPS operating costs, since not only is steam required for stripping but also for producing the sub-atmospheric pressure in the VPS.

A major problem faced at the present time is how to operate a VPS more efficiently, more especially without increasing steam consumption.

It is an object of the present invention to provide an improved VPS fractionation process.

According to the present invention there is provided a process for the sub-atmospheric pressure fractionation of a component comprising a petroleum heavy fraction or atmospheric residuum, comprising:

heating said component and introducing it into a lower region of a pipestill while maintaining a sub-atmospheric pressure within the pipestill and maintaining a pressure drop therein between said lower region and an upper region thereof;

fractionating the component to yield at least one desired hydrocarbon fraction and leave a bottoms residue;

removing said hydrocarbon fraction(s) from the pipestill at location(s) between said lower and upper regions;

stripping the bottom residue of lower boiling point hydrocarbons in a stripping zone in said lower region, the stripping being conducted with a gaseous stripping agent of which at least part is obtained by recycling gaseous mixture present in said upper region of the pipestill and introducing it into or below the bottoms residue.

It is highly preferred that the gaseous stripping agent includes steam, whereby the gaseous mixture recycled will also contain steam; the term steam including in its scope-vapour. However, although predominantly (for example 90 to 95 mole %) steam, the recycled gaseous mixture has an appreciable content of light hydrocarbons which have, of course, a very different composition and flash point from the bottoms residue to which the mixture is recycled. It is very unexpected and surprising that such a gaseous mixture can be recycled without the light hydrocarbons (a) giving rise to explosion, (b) adversely affecting the quality, particularly the flash point of, the VPS bottoms product.

The proportion of the total gaseous mixture in the upper region of the pipestill (the overheads gas) which can be recycled will usually depend upon several factors, including whether the operation is with a fuels-producing, or lube oil-producing VPS. Thus, purely by way of example, and more especially for a fuels VPS, from 30% to 50% of the total overhead gas can be recycled. In all cases it is preferred to pass the remainder to the conventional condensing, separation, and sour water treatment systems associated with a VPS.

The gaseous mixture recycled is taken from an upper region in the VPS and conveyed to the stripping zone in the VPS by any suitable means. Thus, one or more mechanical vacuum pumps may be employed. Preferably, however, one or more steam driven jet ejectors are employed. Based on a pressure drop of about 70 mm Hg between the stripping zone in a VPS and the upper region thereof (e.g. a lube oil-producing VPS), a steam jet ejector could convey the recycle gas on about a 1:1 mass ratio of suction gas:ejector driving steam. For lower pressure drops (e.g. in a gas oil-producing VPS), for example up to 40 to 50 mm Hg, the ratio is 60:40 or higher. Based on this the net fresh stripping steam required for stripping the bottoms in the VPS can be reduced by up to 50% or more of that required in the known conventional VPS operation techniques.

In accordance with an important embodiment of the invention the recycling of the gaseous mixture to the stripping zone is effected wholly within the pipestill. This has the advantage of avoiding locating high-temperature-carrying, low-pressure-carrying, conduits in atmospheric pressure environment.

The gaseous mixture is preferably recycled by driving the mixture with steam through compression means, suitably one or more ejectors, to raise the pressure of the mixture to at least that of the stripping zone of the VPS.

The stripping zone will normally comprise several fractionation trays or equivalent members. Preferably the gaseous mixture is recycled into the bottoms residue in the stripping zone at a location between the first (lowest) and second trays in the zone. It is possible, if required, to add small amounts of fresh steam to the bottom tray (or equivalent member) of the stripping section for the purpose of making any fine adjustment of the flash point of the stripped product.

The component to be fractionated may be a heavy fraction, which term includes a topped crude oil; but is normally one or more (such as a blend) residues from the atmospheric fractionation of a crude oil, which residue(s) may have been treated, such as extracted, before being passed to a pipestill furnace for heating. The component may be derived from paraffinic, naphthenic or mixed base crude oils.

Figure 2:
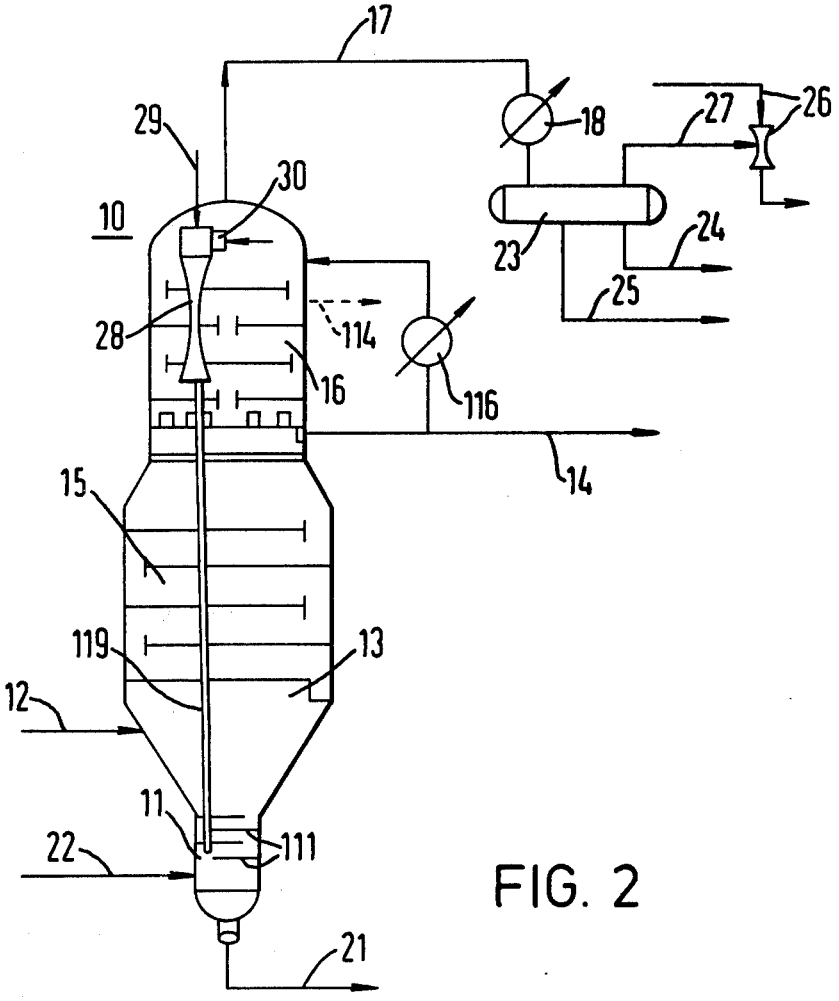

Embodiments of the invention will now be described, by way of non-limitative example, with reference to the accompanying drawings, in which:

FIG. 1 shows, in schematic form, an embodiment employing external recycling, and FIG. 2 shows, in schematic form, an embodiment employing internal recycling.

In the drawings like elements are given the same reference numbers.

Referring to FIG. 1 of the drawings, a fuel-producing (vacuum gas oil-producing) vacuum pipestill (VPS) is designated generally at 10. It has a conventional stripping zone 11, an entry 12 for feed (for example a not atmospheric residuum) and a flash zone 13. Again, conventionally, it has a vacuum gas oil off-take line at 14. Off-take lines for one or more lighter fractions may be provided, one such is indicated by the broken line 114. A washing zone is indicated at 15 and a pump-around zone at 16. The pump-around is conventional and includes a heat exchanger 116 to recover heat which is of value in, for example, steam pre-heating/producing.

A conventional overheads off-take line 17 leads to a heat exchanger 18 and condenser 23. From condenser 23 outlets 24 and 25 are provided for, respectively, sour water and light hydrocarbons.

Sub-atmospheric pressure in the VPS is maintained by means of one or more steam jet ejectors, or stages of ejectors, designated generally at 26, connected to the system through line 27.

The VPS 10 is provided with a return line 19 (which can be taken directly from the VPS as shown or from line 17 outside the VPS), which is connected to a steam driven ejector 20 and thence via line 219 to the stripping zone 11. The stripping zone 11 is illustrated with four stripping plates. Return line 219 is located between the first (lowest) and second of these. The stripping zone 11 is also provided with an outlet 21 for stripped bottoms product, and an inlet 22 for any auxiliary, make-up, steam required in operation.

In a typical operation of this embodiment, feed from a VPS preheat furnace enters a lower region of the VPS via line 12 at about 430° C. The pressure in flash zone 13 is about 70 to 110 mm Hg. The vacuum gas oil product is taken in line 14 at about 370° C. From line 14 it can be sent to any desired subsequent process, for example thermal or catalytic cracking. The light hydrocarbons from the flashing zone 13, together with steam and hydrocarbons from stripping zone 11 pass up the VPS and exit at a pressure of about 40 to 60 mm Hg and a temperature of 65° to 95° C. The pressure drop between zone 11 and the top of the VPS is arranged to be in the range 30 to 70 mm Hg.

Part of the gaseous mixture (by which is included steam, water vapour, light hydrocarbons) in the upper region of the VPS is taken via line 17 to the condensing, hydrocarbon removal, sour water treatment system 18, 23–25. The remainder of the gaseous mixture in the upper region of the VPS is taken via re-cycle line 19 through the steam ejector 20 and line 219 to the stripping zone 11. In stripping zone 11 the gas acts as a stripping agent for the bottoms product dropping into zone 11 from the flash zone 13. Stripped bottoms product is taken via line 21 for further treatment, for example for production of asphalt, or for residual or heavy fuel oil. Small amounts of fresh stripping steam for flash point correction of the bottoms product may be required and, if so, is introduced via line 22.

Referring to FIG. 2 of the drawing, it will be seen that recycle of gaseous mixture from the upper region of the VPS 10 is effected wholly internally in the VPS. Thus, gaseous mixture enters an elongated ejector 28 (driven by fresh steam from line 29) via a filter inlet 30. From ejector 28 a return line 119 depends into the stripping zone 11. The plates in the washing and stripping zones are bored to pass that return line. As before, the return line ends at a location between the first (lowest) and second plates 111 in the stripping zone 11.

The operation of this embodiment is fundamentally the same as that described with reference to FIG. 1.

Having described the process and apparatus of the invention it is stressed that there are two major ways in which substantial advantages may be obtained.

Firstly, if (by comparison with a base case, viz. the conventional VPS operation) (i) feed rates to the VPS, (ii) the vacuum gas oil and bottoms products, remain about the same with respect to quantity and quality, then the amount of fresh steam required is drastically reduced.

Secondly, again by comparison with the base case, if the fresh steam consumption is merely maintained at the same level, then because of the recycling there can be a substantial increase (e.g. 5 LV%) in yield of vacuum gas oil. A cutting point increase of some 10° C. to 15° C. can be obtained in the VPS.

The following Example illustrates the foregoing points.

In a conventional VPS working on an atmospheric residuum to produce vacuum gas oil (called Base Case) an amount 'X' kg/hour of steam was required as stripping steam. This is Test 1 in the Table below. In a Test 2, a recycle operation in accordance with the invention was performed. Steam and recycle quantities are shown, relative to Test 1, in the Table below. In a final test, Test 3, the steam quantity of Test 2, and recycle were employed; the quantities are shown relative to Test 1 in the Table below.

TABLE

| | Test 1 | Test 2 | Test 3 |
|---|---|---|---|
| A. Fresh Stripping Steam | X | 9% X | 9% X |

TABLE-continued

| | Test 1 | Test 2 | Test 3 |
|---|---|---|---|
| B. Fresh Steam Required for Recycling Gases from the VPS | — | 47% X | 99% X |
| C. Quantity of gases recycled from VPS | — | 50% X | 103% X |
| Total A + B + C, being total stripping gas | X | 106% X | 211% X |

N.B. All units are kg/h

Referring to Test 2, it will be seen that a total of 6% more stripping gas was employed than in Test 1. However, and most importantly, whereas 100% fresh steam was required in Test 1, only 56% of that quantity of fresh steam was required in Test 2. This represents a 44% savings in fresh steam requirement when operating in accordance with the present invention.

Referring to Test 3, a total of 8% more fresh steam was employed than in Test 1. This, plus the recycle, gave a total stripping quantity of 211% of that of Test 1. The result was that a 10° C. deeper cut point was obtained in the residuum, giving rise to a substantial increase in yield of vacuum gas oil. No deterioration was observed in the product quality of the vacuum gas oil. The draw-off temperature of the vacuum gas oil in Test 3 was observed to be some 2° C. higher than in Test 1, a small but significant increase.

The procedures of Tests 2 and 3 therefore represent substantial technical advances in VPS operation, and can be used interchangeably.

I claim:

1. In a process for the sub-atmospheric pressure fractionation of a heated petroleum residuum wherein said residuum is introduced into a lower region of a pipestill while maintaining a sub-atmospheric pressure within the pipestill and maintaining a pressure drop therein between said lower region and an upper region thereof, said residuum is fractionated to yield at least one hydrocarbon fraction and a bottoms residue, said hydrocarbon fraction(s) is removed from the pipestill at location(s) between said lower and upper region and said bottoms residue is stripped of lower boiling point hydrocarbons in a stripping zone in said lower region, the improvement which comprises employing a steam-containing gaseous stripping agent of which at least a part is obtained by taking a steam-containing gaseous mixture present in said upper region of said pipestill and recycling said gaseous mixture directly and in uncondensed form into or below said bottoms residue in said lower region of said pipestill.

2. A process as claimed in claim 1, wherein the recycling of said gaseous mixture is effected by driving it with steam through compression means which raise the pressure of the mixture to at least that of the stripping zone.

3. A process as claimed in claim 1 or claim 2, wherein the recycling of said gaseous mixture is effected wholly within the pipestill.

4. A process as claimed in claim 1, wherein the recycled gaseous mixture is introduced into said bottoms residue above the lowest level thereof in the stripping zone.

5. A process as claimed in claim 4, wherein a minor quantity of fresh stripping agent is introduced below the lowest level of the bottoms residue in the stripping zone.

6. A process as claimed in claim 1, wherein the recycling of said gaseous mixture is effected wholly within the pipestill; the recycled mixture is introduced into said bottoms residue above the lowest level thereof in the stripping zone; and a minor quantity of fresh steam is introduced below the lowest level of the bottoms residue in the stripping zone.

7. Apparatus for conducting sub-atmospheric fractionation of a petroleum residuum, comprising in combination a vacuum tower; a stripping zone in a lower region thereof; a residuum feed-line, said feed-line having an inlet into the tower above said stripping zone; a stripped-residuum removal line below said stripping zone; a flash zone above said feed-line inlet; at least one fractionated-product removal line from said flash zone; an upper region above said flash zone for receiving gaseous products from said flash zone; a withdrawal line for withdrawing gaseous products from said upper region; means for condensing said gaseous products, said means communicating with said withdrawal line; vacuum-generating means communicating with said withdrawal line for maintaining sub-atmospheric pressure within the tower; a recycle line effecting essentially only direct communication between said upper region of the tower and said stripping zone thereof; and compression means in said recycle line for delivering gaseous products in uncondensed form via said recycle line directly from said upper region of the tower to said stripping zone.

8. Apparatus as claimed in claim 7, wherein said recycle line and said compression means lie wholly within the vacuum tower.

* * * * *